US007735384B2

(12) United States Patent
Usami et al.

(10) Patent No.: US 7,735,384 B2
(45) Date of Patent: Jun. 15, 2010

(54) STARTER WITH RELIABLE FULCRUM SUPPORTER SUPPORTING FULCRUM PORTION OF SHIFT LEVER

(75) Inventors: Shinji Usami, Okazaki (JP); Mitsuhiro Murata, Niwa-gun (JP); Kazuyuki Kito, Nagoya (JP)

(73) Assignee: Denso Corporation, Kariya (JP)

( * ) Notice: Subject to any disclaimer, the term of this patent is extended or adjusted under 35 U.S.C. 154(b) by 749 days.

(21) Appl. No.: 11/439,200

(22) Filed: May 24, 2006

(65) Prior Publication Data

US 2006/0266137 A1 Nov. 30, 2006

(30) Foreign Application Priority Data

May 31, 2005 (JP) ..... 2005-159241

(51) Int. Cl.
*F02N 15/00* (2006.01)
*F02N 15/04* (2006.01)
*F02N 15/06* (2006.01)
*F02N 15/02* (2006.01)

(52) U.S. Cl. ..... 74/7 A; 74/7 E; 74/7 R

(58) Field of Classification Search ..... 74/6, 74/7 A, 7 C, 7 E, 7 R
See application file for complete search history.

(56) References Cited

U.S. PATENT DOCUMENTS 5,295,404 A * 3/1994 Spellman et al. ..... 74/7 A
5,307,700 A * 5/1994 Spellman et al. ..... 74/7 A
5,353,658 A * 10/1994 Nagashima et al. ..... 74/7 A
5,370,009 A 12/1994 Isozumi
5,718,147 A 2/1998 Clerc-Roch et al.
5,848,551 A * 12/1998 Ohmi et al. ..... 74/7 C
5,953,955 A 9/1999 Shiga et al.
6,134,977 A 10/2000 Wessels (Continued)

FOREIGN PATENT DOCUMENTS

CN 1222955 A 7/1999

(Continued)

OTHER PUBLICATIONS

Caifen, Li; "First Office Action"; State Intellectual Property Office, P.R. China; Sep. 5, 2008.

(Continued)

*Primary Examiner*—Thomas R Hannon
*Assistant Examiner*—Justin Krause
(74) *Attorney, Agent, or Firm*—Oliff & Berridge, PLC

(57) ABSTRACT

A starter includes a motor, an output shaft, a pinion gear, a lever, a lever actuator, a supporting frame, and a fulcrum supporter. The motor includes a rotation shaft to which the output shaft is linked. The pinion gear is provided on the output shaft and configured to mesh with a ring gear of an engine to start the engine. The lever has a first end, a second end that is linked the pinion gear, and a fulcrum portion. The lever actuator works to move the first end of the lever to pivot the second end on the fulcrum portion. The supporting frame rotatably supports the output shaft. The fulcrum supporter, which is integrally formed with the supporting frame, works to support the fulcrum portion of the lever to achieve pivotal movement of the second end to bring the pinion gear into mesh with the ring gear of the engine.

13 Claims, 5 Drawing Sheets

U.S. PATENT DOCUMENTS

| | | | | |
|---|---|---|---|---|
| 6,490,940 | B1 * | 12/2002 | Izquierdo et al. | 74/7 E |
| 6,619,145 | B2 * | 9/2003 | Hosoya | 74/7 E |
| 6,789,438 | B2 * | 9/2004 | Tanaka et al. | 74/7 E |
| 2004/0180750 | A1 | 9/2004 | Katoh et al. | |
| 2004/0231442 | A1 | 11/2004 | Saito et al. | |
| 2005/0057046 | A1 | 3/2005 | Kitagawa et al. | |
| 2005/0115339 | A1 | 6/2005 | Aoki et al. | |

FOREIGN PATENT DOCUMENTS

| | | | |
|---|---|---|---|
| CN | 1611767 | A | 5/2005 |
| FR | 2 356 015 | A1 | 1/1978 |
| GB | 1 551 643 | A | 8/1979 |
| JP | A-53-129742 | | 11/1978 |
| JP | U-61-187970 | | 11/1986 |
| JP | B2 6-63491 | | 10/1987 |
| JP | A 05-263738 | | 10/1993 |
| JP | A 2004-251168 | | 9/2004 |
| JP | A-2004-278352 | | 10/2004 |
| JP | A-2005-110484 | | 4/2005 |
| WO | WO 96/16265 | | 5/1996 |
| WO | WO 03/025425 | A1 | 3/2003 |

OTHER PUBLICATIONS

Translation of German Office Action issued on Sep. 13, 2007 in German Application No. 10 2006 024 465. 6-15.

* cited by examiner

STARTER WITH RELIABLE FULCRUM SUPPORTER SUPPORTING FULCRUM PORTION OF SHIFT LEVER

CROSS-REFERENCE TO RELATED APPLICATION

This application is based on and claims priority from Japanese Patent Application No. 2005-159241, filed on May 31, 2005, the content of which is hereby incorporated by reference into this application.

BACKGROUND OF THE INVENTION

1. Technical Field of the Invention

The present invention relates generally to starters in which a pinion gear is brought into mesh with a ring gear of an engine via a shift lever to start the engine.

More particularly, the invention relates to a starter that has a fulcrum supporter to support a fulcrum portion of a shift lever during pivotal movement of the shift lever to bring a pinion gear into mesh with a ring gear of an engine.

2. Description of the Related Art

Japanese Patent First Publication No. H05-263738, an English equivalent of which is U.S. Pat. No. 5,370,009, discloses a starter in which a shift lever is driven by a solenoid switch to bring a pinion gear into mesh with a ring gear of an engine.

According to the disclosure, the shift lever has a fulcrum portion as the center of pivotal movement of the shift lever to bring the pinion gear into mesh with the ring gear. The fulcrum portion is disposed inside a recess formed in a housing of the starter and supported by a rubber caulk, which is fitted to an opening of the recess, during the pivotal movement of the shift lever.

However, in the above starter, the rubber caulk is provided in the form of an independent component of the starter and used only for the purpose of supporting the fulcrum portion of the shift level. Consequently, both the parts count of the starter and the man-hour requirement for assembly of the starter are increased.

Further, since the rubber caulk is in the form of an independent component, it is necessary to firmly support or secure the rubber caulk so as to prevent it from dropping out during operation of the starter. This will further increase the man-hour requirement for assembly of the starter, thus lowering the productivity of the starter.

Furthermore, in the above starter, the shift lever has a first end linked to a plunger of the solenoid switch and a second end linked to the pinion gear, so that a movement of the plunger causes, via the first end, the second end to pivot on the fulcrum portion, thereby bringing the pinion gear into mesh with the ring gear of the engine. During the pivotal movement of the second end on the fulcrum portion, the rubber caulk, which functions as a fulcrum supporter, is compressed and deformed, resulting in a deviation in the position of the fulcrum portion. This deviation will cause a deviation in closing time of main contacts of the solenoid switch, thereby degrading the meshing performance of the pinion gear with the ring gear of the engine.

SUMMARY OF THE INVENTION

The present invention has been made in view of the above-mentioned problems.

It is, therefore, a primary object of the present invention to provide a starter having an improved structure, with which it is possible to reduce both the parts count of the starter and the man-hour requirement for assembly of the starter and improve the meshing performance of a pinion gear of the starter with a ring gear of an engine.

According to the present invention, a starter is provided which includes a motor, an output shaft, a pinion gear, a lever, a lever actuator, a supporting frame, and a fulcrum supporter.

The motor includes a rotation shaft and works to output a torque via the rotation shaft.

The output shaft is linked to the rotation shaft of the motor to receive the torque.

The pinion gear is provided on the output shaft. The pinion gear is configured to mesh with a ring gear of an engine and transmit the torque from the output shaft to the ring gear to start the engine.

The lever has a first end, a second end, and a fulcrum portion between the first and second ends. The second end is linked to the pinion gear.

The lever actuator works to move the first end of the lever to pivot the second end on the fulcrum portion.

The supporting frame is provided to rotatably support the output shaft.

The fulcrum supporter works to support the fulcrum portion of the lever to achieve pivotal movement of the second end to bring the pinion gear into mesh with the ring gear of the engine. The fulcrum supporter is integrally formed with the supporting frame.

With the above structure, both the parts count of the starter and the man-hour requirement for assembly of the starter are reduced due to the integral formation of the fulcrum supporter with the supporting frame.

Further, due to the integral formation, the fulcrum portion is reliably prevented from dropping out during operation of the starter without additional means or devices to support or secure it. Consequently, it becomes possible to further reduce both the parts count of the starter and the man-hour requirement for assembly of the starter, thus making it possible to improve the productivity of the starter.

In the starter according to the present invention, it is preferable that both the supporting frame and the fulcrum supporter are made of a metal.

Consequently, when the second end of the lever is pivoted on the fulcrum portion and thus a load is imposed on the fulcrum supporter, the fulcrum supporter can be kept from moving due to the high rigidity of the supporting frame and the fulcrum supporter.

Accordingly, it becomes possible to prevent any deviation in the position of the fulcrum portion of the lever, thereby reliably securing the meshing performance of the pinion gear with the ring gear of the engine.

According to a further implementation of the present invention, the fulcrum supporter is so integrally formed with the supporting frame as to protrude outward in the radial direction of the output shaft from an outer periphery of the supporting frame.

The lever actuator is a solenoid switch that includes a solenoid, a plunger, and a set of contacts. The solenoid switch is so configured that energizing the solenoid causes the plunger to move to close the contacts, thereby supplying electric power to the motor. The plunger is linked to the first end of the lever so that a movement of the plunger causes the first end to move to pivot the second end on the fulcrum portion.

The starter further includes a seal member that is interposed between the fulcrum supporter and the solenoid switch in tight contact therewith.

The starter further includes a housing that accommodates at least the lever, the fulcrum supporter, and the supporting frame. The fulcrum portion of the lever is pivotably disposed in a recess formed in an inner wall of the housing, and the fulcrum supporter is fitted to an opening of the recess.

The supporting frame has a positioning portion for positioning the supporting frame with respect to the housing, by which rotational movement of the supporting frame with respect to the housing is restricted.

The starter further includes a power transmission device provided between the rotation shaft of the motor and the output shaft to transmit the torque from the rotation shaft of the motor to the output shaft. The power transmission device includes a rotation shaft portion that is fixed to the output shaft and supported by the supporting frame via a bearing arranged on an inner periphery of the supporting frame.

The rotation shaft portion of the power transmission device may be integrally formed with the output shaft.

The power transmission device may be an epicycle reduction gear that transforms a higher speed rotation of the rotation shaft of the motor to a lower speed rotation of the output shaft. The rotation shaft portion of the power transmission device may be a planetary gear carrier shaft of the epicycle reduction gear.

The starter further includes a casing that accommodates the power transmission device and has an end face and an opening formed through the end face. The supporting frame has an annular outer portion and a hollow cylindrical inner portion. The outer portion has a side face abutting the end face of the casing and an outer periphery from which the fulcrum supporter protrudes outward. The inner portion extends in the axial direction of the output shaft to fit into the opening of the casing and has an inner periphery on which the bearing is arranged.

The motor includes a yoke and the casing is integrally formed with the yoke.

The starter further includes a shock absorption mechanism, which is provided between the supporting frame and the power transmission device and works to absorb, when the torque transmitted from the rotation shaft of the motor to the power transmission device is above a predetermined value, a shock made to the supporting frame due to the torque.

The shock absorption mechanism may be composed of a plurality of fixed walls, a plurality of movable walls, and a plurality of elastic members. The fixed walls are integrally formed with the supporting frame and extend in the axial direction of the output shaft. The movable walls are integrally formed with the power transmission device and extend in the axial direction of the output shaft. The fixed and movable walls are alternately disposed in the circumferential direction of the output shaft overlapping each other. Each of the elastic members is interposed between an adjacent pair of one of the fixed walls and one of the movable walls. The movable walls are allowed to rotate, when the torque transmitted to the power transmission device is above the predetermined value, to compress and deform the elastic members, thereby absorbing the shock caused due to the torque.

BRIEF DESCRIPTION OF THE DRAWINGS

The present invention will be understood more fully from the detailed description given hereinafter and from the accompanying drawings of the preferred embodiment of the invention, which, however, should not be taken to limit the invention to the specific embodiment but are for the purpose of explanation and understanding only.

In the accompanying drawings.

DESCRIPTION OF THE PREFERRED EMBODIMENT

Figure 1:
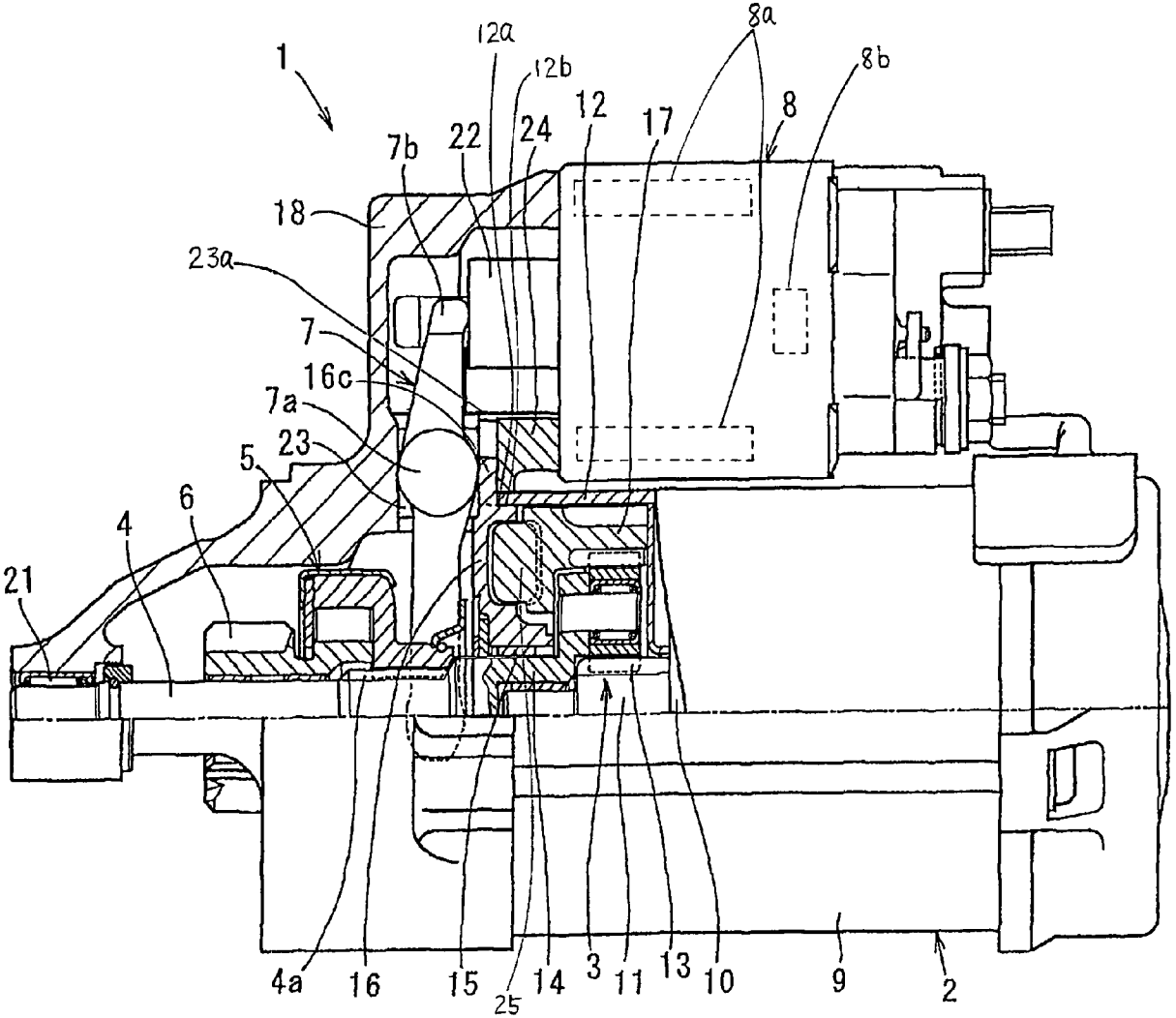
FIG. 1 is a partially cross-sectional side view showing the overall structure of a starter according to an embodiment of the invention.

The preferred embodiment of the present invention will be described hereinafter with reference to FIGS. 1-5.

It should be noted that, for the sake of clarity and understanding, identical components having identical functions have been marked, where possible, with the same reference numerals in each of the figures.

FIG. 1 shows the overall structure of a starter 1 according to an embodiment of the invention, which is designed to start an internal combustion engine (not shown) of an automobile.

As shown in FIG. 1, the starter 1 mainly includes a starter motor 2, a speed reduction gear 3, an output shaft 4, a clutch 5, a pinion gear 6, a shift lever 7, a solenoid switch 8, a casing 12, a supporting frame 16, and a housing 18.

The starter motor 2 works to generate a torque (or turning force). The starter motor 2 is a DC motor of well-known type, which includes a magnetic filed system and an armature 10.

The magnetic field system works to create a magnetic field. The magnetic field system is configured with a yoke 9 for forming a magnetic circuit and a plurality of permanent magnets (not shown) arranged on an inner periphery of the yoke 9. The yoke 9 also serves as a frame of the starter motor 2. In addition, it should be noted that field windings may also be used, instead of the permanent magnets, to create the magnetic field.

The armature 10 is rotatably disposed within the magnetic field system and includes an armature shaft 11 via which the torque generated by the starter motor 2 is outputted.

The speed reduction gear 3 is connected between the armature shaft 11 of the starter motor 2 and the output shaft 4 to transmit the torque outputted from the armature shaft 11 to the output shaft 4 while transforming a higher speed rotation of the armature shaft 11 to a lower speed rotation of the output shaft 4. The speed reduction gear 3 is of a well-known epicyclic type and disposed within the casing 12 that is formed by extending the yoke 9 of the starter motor 2 in the axial direction toward the output shaft 4 (i.e., leftward in FIG. 1). The speed reduction gear 3 includes a sun gear, a plurality of planetary gears 13, a planetary gear carrier shaft 14, and an integral gear 17. The sun gear is mounted on the armature shaft 11 of the starter motor 2. The planetary gears 13 are in mesh with both the sun gear and the internal gear 17. The planetary gear carrier shaft 14, which works to output the orbital motion of the planetary gears 13, is rotatably supported by the supporting frame 16 via a bearing 15 arranged on an inner periphery of the supporting frame 16. The internal gear 17 is rotatable with respect to the casing 12; however, the rotational movement of the internal gear 17 is limited by the supporting frame 16 via a shock absorption mechanism 25 that is to be described in detail later.

The output shaft 4 is, as described above, linked to the armature shaft 11 of the starter motor 2 via the speed reduction gear 3. More specifically, one end of the output shaft 4 is integrally formed with the planetary gear carrier shaft 14 of the speed reduction gear 3; the other end is supported by the housing 18 via a bearing 21 arranged on an inner periphery of the housing 18. The housing 18 accommodates at least the output shaft 4, the clutch 5, the pinion gear 6, the shift lever 7, and the supporting frame 16.

Figure 2B:
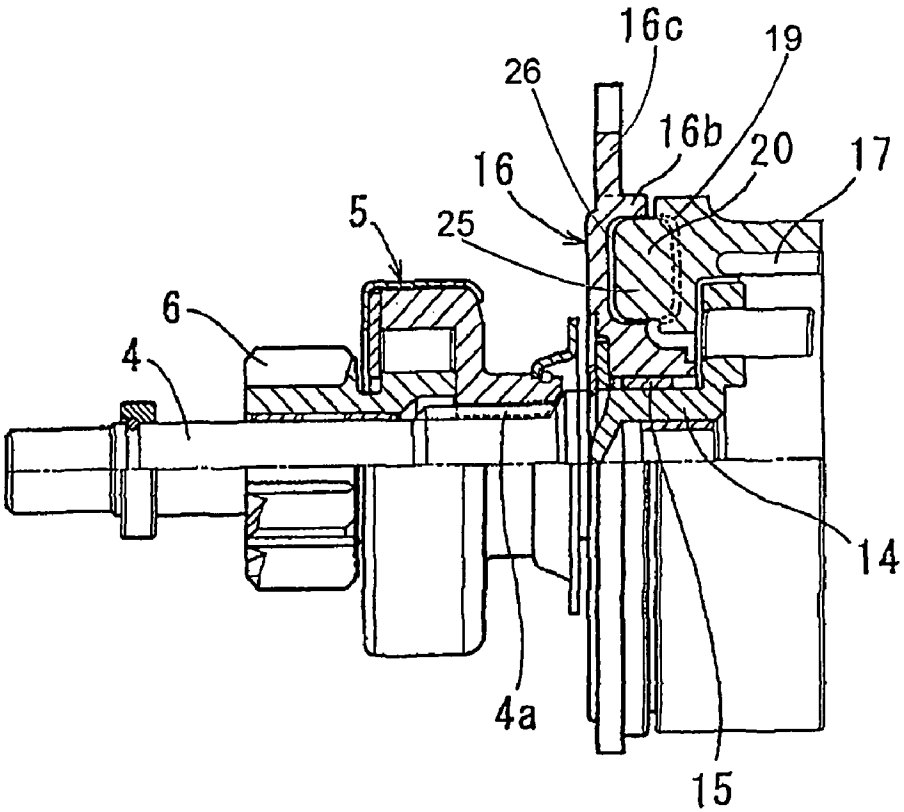
FIG. 2B is a partially cross-sectional side view showing the output shaft unit of FIG. 2A.
Figure 2A:
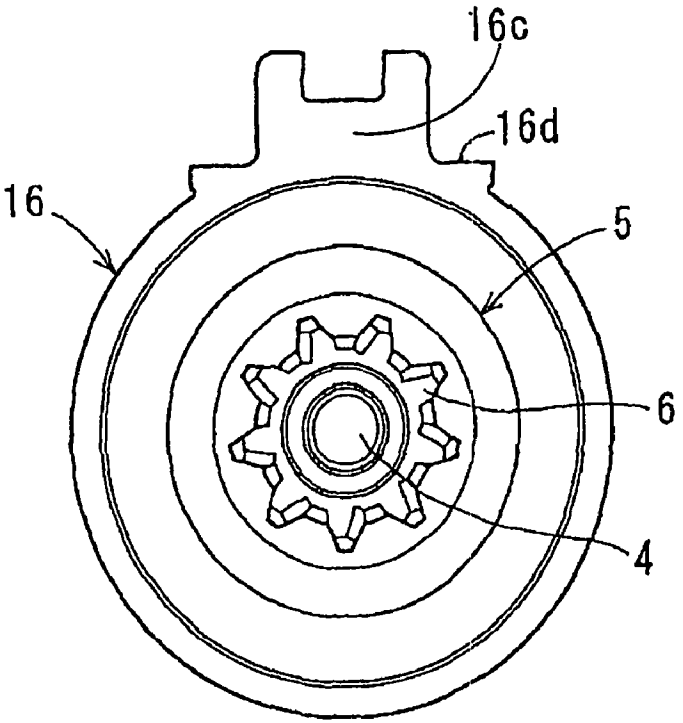
FIG. 2A is an end view showing an output shaft unit of the starter of FIG. 1.

Turning to FIGS. 2A-2B, the output shaft 4 is assembled with the clutch 5, the pinion gear 6, the supporting frame 16, and the internal gear 17 to form an output shaft unit of the starter 1.

The clutch 5 is, as shown in FIG. 2B, provided on the output shaft 4 along with the pinion gear 6 and engages with helical splines 4*a* formed on the output shaft 4. The clutch 5 is a one-way clutch which can transmit the torque generated by the starter motor 2 from the output shaft 4 to the pinion gear 6 while being capable of preventing an adverse torque transmission from the pinion gear 6 to the output shaft 4 when the rotational speed of the pinion gear 6 exceeds that of the output shaft 4 after start of the engine.

The pinion gear 6 is configured to move, together with the clutch 5, along the output shaft 4 toward a direction away from the starter motor 2 to mesh with a ring gear (not shown) of the engine and transmit the torque generated by the starter motor 2 to the ring gear.

The solenoid switch 8 includes a solenoid 8*a* (illustrated in FIG. 1 with dashed lines), a plunger 22, a set of main contacts 8*b* (illustrated in FIG. 1 with dashed lines), and a returning spring (not shown).

The solenoid 8*a* is configured to form an electromagnet when supplied with electric power from a battery (not shown) upon closing a starter switch (not shown). This electromagnet attracts the plunger 22 to move in the rightward direction of FIG. 1 to close the main contacts 8*b*, thereby supplying electric power to the starter motor 2. The return spring returns the plunger 22 to the initial position thereof when the magnetic attraction disappears due to stop of the electric power supply to the solenoid 8*a*.

Figure 3A:
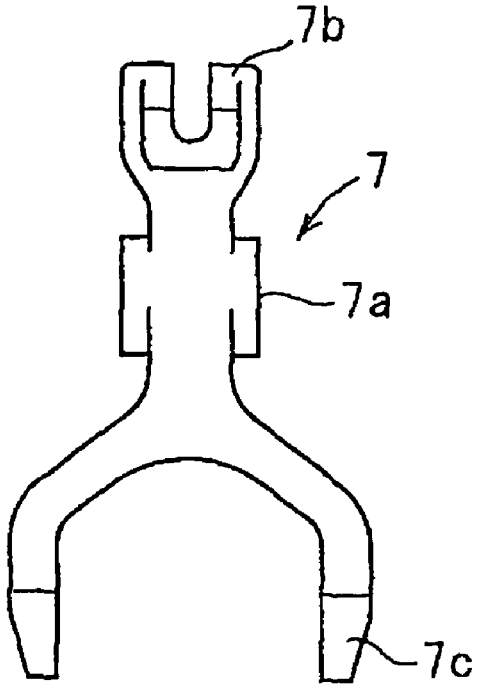
FIG. 3A is a front view of a shift lever of the starter of FIG. 1.
Figure 3B:
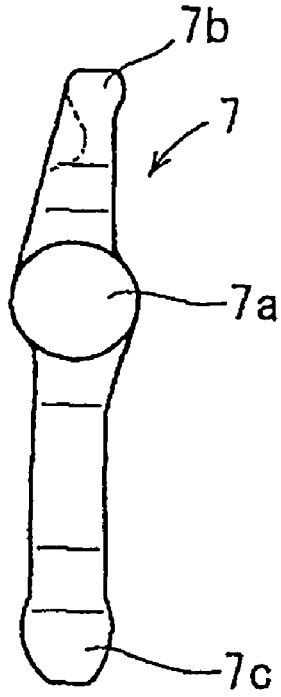
FIG. 3B is a side view of the shift lever of FIG. 3A.

The shift lever 7 has, as shown in FIGS. 3A-3B, a fulcrum portion 7*a*, a first end 7*b*, and a second end 7*c*.

Figure 4:
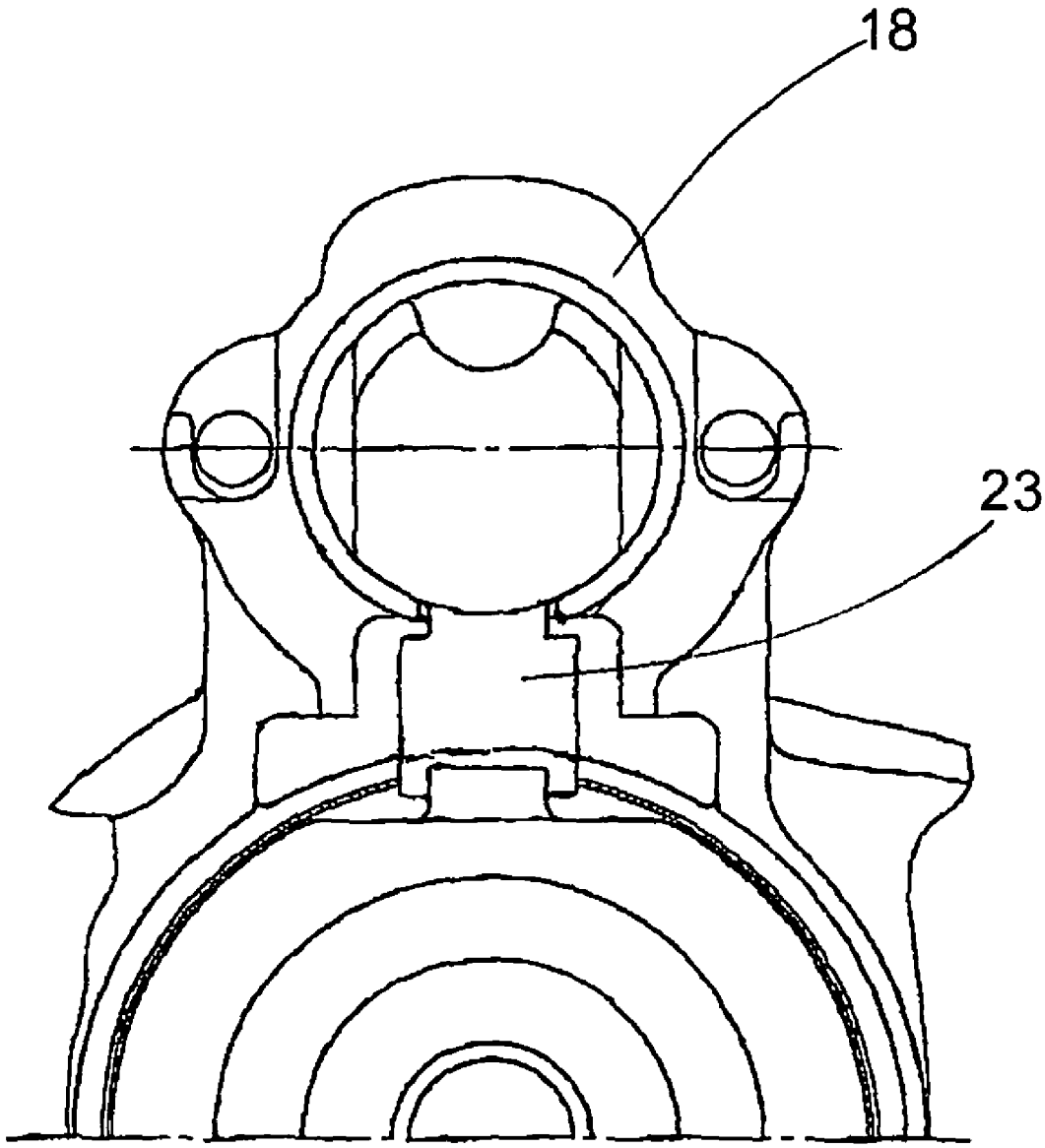
FIG. 4 is an end view showing a recess formed in a housing of the starter of FIG. 1.

The fulcrum portion 7*a* is cylindrical in shape and both the first and second ends 7*b* and 7*c* are two-pronged. The fulcrum portion 7*a* is pivotably disposed in a recess 23 that is formed in the inner wall of the housing 18 as shown in FIGS. 1 and 4. The first end 7*b* is connected to the plunger 22 of the solenoid switch 8 while the second end 7*c* engages with the clutch 5, thereby transmitting motion of the plunger 22 to the clutch 5. More specifically, when the plunger 22 is attracted to move in the rightward direction of FIG. 1, the first end 7*b* is also attracted to move in the same direction, so that the second end 7*c* is caused to pivot on the fulcrum portion 7*a*, pushing the clutch 5 and the pinion gear 6 in the leftward direction of FIG. 1. During this pivotal movement of the shift lever 7, the fulcrum portion 7*a* is supported by a fulcrum supporter to be described below.

Figure 5A:
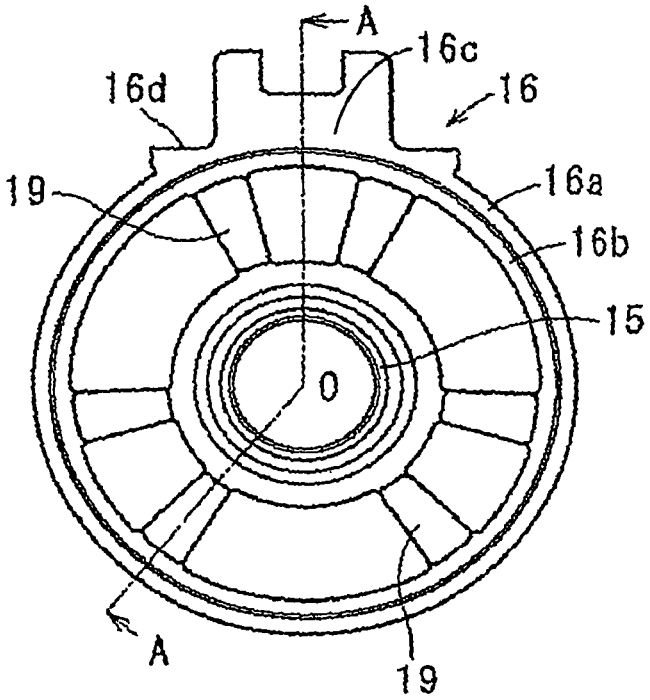
FIG. 5A is an end view of a supporting frame of the starter of FIG. 1.
Figure 5B:
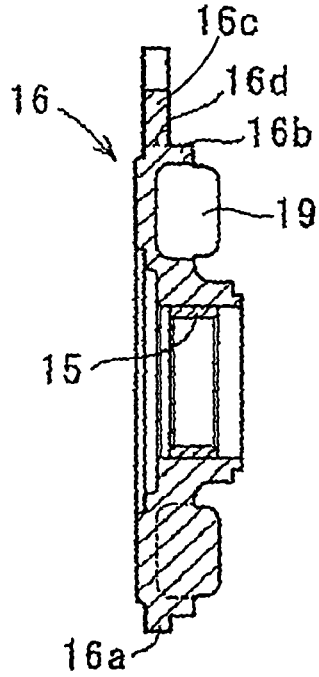
FIG. 5B is a cross-sectional view of the supporting frame taken along the line A-O-A in FIG. 5A.

Referring now to FIGS. 5A-5B, the supporting frame 16 has an annular outer portion 16*a*, a hollow cylindrical inner portion 16*b*, a protruding portion 16*c*, and a pair of positioning portions 16*d*. The supporting frame 16 is made of a metal such as aluminum.

A side face of the outer portion 16*a* abuts an end face 12*a* of the casing 12, through which an opening 12*b* of the casing 12 is formed, while the inner portion 16*b* extends in the axial direction to fit into the opening 12*b*, thereby closing the opening 12*b* as shown in FIG. 1.

The protruding portion 16*c* is so formed to protrude radially outward from the outer portion 16*a*. The protruding portion 16*c* is fitted to an opening 23*a* of the recess 23 to function as the fulcrum supporter for the fulcrum portion 7*a* of the shift lever 7.

The positioning portions 16*d* are respectively formed on both sides of the protruding portion 16*c*. The positioning portions 16*d* are provided to position, when assembling the supporting frame 16 to the housing 18, the supporting frame 16 with respect to the housing 18 in the circumferential direction. After the assembly, the positioning portions 16*d* work to restrict rotational movement of the supporting frame 16 with respect to the housing 18.

Referring again to FIG. 2B, in the starter 1, there is provided the shock absorption mechanism 25 between the supporting frame 16 and the internal gear 17 of the speed reduction gear 3.

The shock absorption mechanism 25 is composed of a plurality of fixed walls 19, a plurality of movable walls 20, and a plurality of elastic members 26.

As shown in FIGS. 5A-5B, the fixed walls 19 are so integrally formed with the supporting frame 16 as to protrude from the inner portion 16*b* in the axial direction with a plate shape and be spaced from each other in the circumferential direction. On the other hand, the movable walls 20 are so integrally formed with the internal gear 17 as to protrude from the internal gear 17 in the axial direction with a plate shape and be spaced from each other in the circumferential direction. The elastic members 26 are made of an oil resistant rubber such as NBR.

After assembly of the starter 1, the fixed walls 19 and the movable walls 20 are alternately disposed in the circumferential direction, overlapping each other. Each of the elastic members 26 is interposed between an adjacent pair of one of the fixed walls 19 and one of the movable walls 20.

The shock absorption mechanism 25 works to absorb, when an excessive torque above a predetermined value is transmitted to the speed reduction gear 3, a shock made to the supporting frame 16 due to the excessive torque. More specially, when the excessive torque is transmitted to the speed reduction gear 3, the movable walls 20 are allowed to rotate, along with the internal gear 17, to compress and deform the elastic members 26, thereby absorbing the shock.

After having described the overall structure of the starter 1, operation thereof will be described hereinafter.

When the starter switch is turned on, electric power is supplied to the solenoid 8*a* of the solenoid switch 8 to form the electromagnet.

The electromagnet attracts the plunger 22 of the solenoid switch 8 to move in the rightward direction of FIG. 1.

This movement of the plunger 22 causes, via the shift lever 7, the clutch 5 and the pinion gear 6 to move along the output shaft 4 in the leftward direction of FIG. 1 until the pinion gear 6 makes contact with an end face of the ring gear of the engine.

Then, the main contacts 8*b* of the solenoid switch 8 are closed, so that electric power is supplied to the starter motor 2 to rotate the armature shaft 11.

The rotation of the armature shaft 11 is then transmitted, through speed reduction by the speed reduction gear 3, to the output shaft 4.

The rotation of the output shaft 4 is further transmitted, via the clutch 5, to the pinion gear 6, thus causing the pinion gear 6 to rotate to an angular position possible for meshing and mesh with the ring gear at that angular position.

With the meshing of the pinion gear 6 with the ring gear, the torque generated by the starter motor 2 is transmitted to the ring gear, thereby cranking the engine.

When the engine starts and the starter switch is turned off, the magnetic attraction attracting the plunger 22 disappears and the return spring returns the plunger 22 to the initial position thereof, thereby opening the main contacts 8*b* of the solenoid switch 8. Consequently, the rotation of the armature shaft 11 is stopped due to the stop of electric power supply to the starter motor 2.

At the same time, the returning movement of the plunger 22 causes, via the shift lever 7, the clutch 5 and the pinion gear 6 to move along the output shaft 4 in the rightward direction of FIG. 1 until returning to the stationary positions thereof shown in FIG. 1.

The above-described starter 1 according to the present embodiment has the following advantages.

In the starter 1, the fulcrum portion 7*a* of the shift lever 7 is pivotably disposed in the recess 23 formed in the inner wall of the housing 18, and the protruding portion 16*c* of the supporting frame 16 is fitted to the opening 23*a* of the recess 23 to support the fulcrum portion 7*a*.

Since the protruding portion 16*c*, which serves as the fulcrum supporter for the fulcrum portion 7*a* of the shift lever 7, is formed as part of the supporting frame 16, not as an independent component of the starter 1, both the parts count of the starter 1 and the man-hour requirement for assembly of the starter 1 are reduced.

Further, due to the integral formation of the fulcrum supporter with the supporting frame 16, the fulcrum supporter is reliably prevented from dropping out during operation of the starter 1 without additional means or devices to support or secure it.

Consequently, it becomes possible to further reduce both the parts count of the starter 1 and the man-hour requirement for assembly of the starter 1, thus making it possible to improve the productivity of the starter 1.

Moreover, when the first end 7*b* of the shift lever 7 is attracted by the plunger 22, in other words, when a load is imposed on the protruding portion 16*c* of the supporting frame 16 via the fulcrum portion 7*a* of the shift lever 7, the protruding portion 16*c* can be kept from moving due to the high rigidity of the supporting frame 16 that is made of a metal.

Furthermore, in the starter 1, the outer portion 16*a* of the supporting frame 16 abuts the end face 12*a* of the casing 12. Therefore, even when the load is imposed on the protruding portion 16*c*, the supporting frame 16 cannot move in the axial direction toward the starter motor 2, thus reliably keeping the protruding portion 16*c* from moving in the same direction.

Consequently, it becomes possible to prevent any deviation in the position of the fulcrum portion 7*a* of the shift lever 7 and thus any deviation in the closing time of the main contacts 8*b* of the solenoid switch 8, thereby reliably securing the meshing performance of the pinion gear 6 with the ring gear of the engine.

In the starter 1 according to the present embodiment, the supporting frame 16 has the positioning portions 16*d*, with which when assembling the supporting frame 16 to the housing 18, it is possible to accurately position the supporting frame 16 with respect to the housing 18 and facilitate the fitting of the protruding portion 16*c* to the opening 23*a* of the recess 23 in the housing 18.

Moreover, after the assembly of the supporting frame 16 to the housing 18, rotational movement of the supporting frame 16 with respect to the housing 18 is restricted by means of the positioning portions 16*d*.

Accordingly, when an excessive torque is transmitted to the speed reduction gear 3, it is possible to keep the supporting frame 16 from moving in the circumferential direction, thereby making it possible to reliably absorb the shock caused due to the excessive torque.

In the starter 1 according to the present embodiment, the shock absorption mechanism 25 is so configured that the fixed walls 19 and the movable walls 20 overlap each other with the elastic members 26 interposed therebetween.

With this configuration, the axial length of the shock absorption mechanism 25 is minimized.

Moreover, a supporting frame, which has no the protruding portion 16*c*, is traditionally arranged in the vicinity of the shift lever 7 to support the planetary gear carrier shaft 14 of the speed reduction gear 3.

Accordingly, the supporting frame 16 according to the present embodiment can be easily obtained on the basis of the traditional supporting frame without a large design change, thus reducing the manufacturing cost of the starter 1.

In the starter 1 according to the present embodiment, the casing 12 is formed by extending the yoke 9 of the starter motor 2 in the axial direction toward the output shaft 4.

With this formation, both the parts count of the starter 1 and the man-hour requirement for assembly of the starter 1 are reduced.

In addition, in the starter 1 according to the present embodiment, a seal member 24 is interposed, as shown in FIG. 1, between the protruding member 16*c* of the supporting member 16 and the solenoid switch 8 in tight contact therewith.

With the seal member 24 sealing the space between the protruding portion 16*c* and the solenoid switch 8, it is possible to prevent the ingress of contaminants from the outside of the starter 1 into the solenoid switch 8.

While the above particular embodiment of the invention has been shown and described, it will be understood by those who practice the invention and those skilled in the art that various modifications, changes, and improvements may be made to the invention without departing from the spirit of the disclosed concept.

For example, in the previous embodiment, the casing 12, which surrounds the speed reduction gear 3, is integrally formed with the yoke 9 of the starter motor 2.

However, the casing 12 may also be formed independently or integrally formed with the supporting frame 16.

In the previous embodiment, the shock absorption mechanism 25 is configured by interposing the elastic members 26 between the fixed walls 19 and the movable walls 20.

However, the shock absorption mechanism 25 may also be configured by using a method of making frictional engagement between sliding and fixed discs.

In the previous embodiment, the pinion gear 6 is configured to move, together with the clutch 5, along the output shaft 4 to mesh with the ring gear of the engine.

However, the pinion gear 6 may also be configured to move, without being accompanied by the clutch 5, along the output shaft 4 to mesh with the ring gear of the engine. Otherwise, the pinion gear 6 may also be configured to be fixed to the output shaft 4, and the output shaft 4 may be configured to be moved via the shift lever 7 to bring the pinion gear 6 into mesh with the ring gear of the engine.

In other words, to implement the present invention, the pinion gear 6 is only required to be moved, by means of the shift lever 7, to mesh with the ring gear of the engine.

In the previous embodiment, the speed reduction gear 3 is provided between the armature shaft 11 of the starter motor 2 and the output shaft 4.

However, the speed reduction gear 3 may be omitted, and thus the armature shaft 11 and the output shaft 4 may be directly connected to each other.

Such modifications, changes, and improvements within the skill of the art are intended to be covered by the appended claims.

What is claimed is:

1. A starter for an engine comprising:

a motor including a rotation shaft and working to output a torque via the rotation shaft;

an output shaft being linked to the rotation shaft of the motor to receive the torque;

a pinion gear provided on the output shaft, the pinion gear being configured to mesh with a ring gear of an engine and transmit the torque from the output shaft to the ring gear to start the engine;

a lever having a first end, a second end, and a fulcrum portion between the first and second ends, the second end being linked to the pinion gear;

a lever actuator working to move the first end of the lever to pivot the second end on the fulcrum portion;

a supporting frame provided to rotatably support the output shaft;

a fulcrum supporter working to support the fulcrum portion of the lever to achieve pivotal movement of the second end to bring the pinion gear into mesh with the ring gear of the engine, the fulcrum supporter being integrally formed with the supporting frame; and a housing that accommodates at least the lever, the fulcrum supporter, and the supporting frame, wherein the fulcrum portion of the lever is pivotably disposed in a recess formed in an inner wall of the housing, and the fulcrum supporter is fitted to an opening of the recess to interpose the fulcrum portion of the lever between the inner wall of the housing and the fulcrum supporter.

2. The starter as set forth in claim 1, wherein both the supporting frame and the fulcrum supporter are made of a metal.

3. The starter as set forth in claim 1, wherein the fulcrum supporter is integrally formed with the supporting frame to protrude outward in a radial direction of the output shaft from an outer periphery of the supporting frame.

4. The starter as set forth in claim 1, wherein the lever actuator is a solenoid switch that includes a solenoid, a plunger, and a set of contacts, the solenoid switch being so configured that energizing the solenoid causes the plunger to move to close the contacts, thereby supplying electric power to the motor, and wherein the plunger is linked to the first end of the lever so that a movement of the plunger causes the first end to move to pivot the second end on the fulcrum portion.

5. The starter as set forth in claim 4, further comprising a seal member that is interposed between and abuts the fulcrum supporter and the solenoid switch.

6. The starter as set forth in claim 1, wherein the supporting frame has a positioning portion for positioning the supporting frame with respect to the housing, by which rotational movement of the supporting frame with respect to the housing is restricted.

7. The starter as set forth in claim 1, further comprising a power transmission device provided between the rotation shaft of the motor and the output shaft to transmit the torque from the rotation shaft of the motor to the output shaft, wherein the power transmission device includes a rotation shaft portion that is fixed to the output shaft and supported by the supporting frame via a bearing arranged on an inner periphery of the supporting frame.

8. The starter as set forth in claim 7, wherein the rotation shaft portion of the power transmission device is integrally formed with the output shaft.

9. The starter as set forth in claim 7, wherein the power transmission device is an epicycle reduction gear that transforms a higher speed rotation of the rotation shaft of the motor to a lower speed rotation of the output shaft, and wherein the rotation shaft portion of the power transmission device is a planetary gear carrier shaft of the epicycle reduction gear.

10. The starter as set forth in claim 7, further comprising a casing that accommodates the power transmission device and has an end face and an opening formed through the end face, wherein the supporting frame has an annular outer portion and a hollow cylindrical inner portion, the outer portion having a side face abutting the end face of the casing and an outer periphery from which the fulcrum supporter protrudes outward, the inner portion extending in an axial direction of the output shaft to fit into the opening of the casing and having an inner periphery on which the bearing is arranged.

11. The starter as set forth in claim 10, wherein the motor includes a yoke and the casing is integrally formed with the yoke.

12. The starter as set forth in claim 7, further comprising a shock absorption mechanism that is provided between the supporting frame and the power transmission device and works to absorb, when the torque transmitted from the rotation shaft of the motor to the power transmission device is above a predetermined value, a shock made to the supporting frame due to the torque.

13. The starter as set forth in claim 12, wherein the shock absorption mechanism is composed of a plurality of fixed walls, a plurality of movable walls, and a plurality of elastic members, the fixed walls being integrally formed with the supporting frame and extending in the axial direction of the output shaft, the movable walls being integrally formed with the power transmission device and extending in the axial direction of the output shaft, the fixed and movable walls being alternately disposed in a circumferential direction of the output shaft overlapping each other, each of the elastic members being interposed between an adjacent pair of one of the fixed walls and one of the movable walls, and wherein the movable walls are allowed to rotate, when the torque transmitted to the power transmission device is above the predetermined value, to compress and deform the elastic members, thereby absorbing the shock caused due to the torque.

* * * * *